US009460691B2

(12) United States Patent
Kim

(10) Patent No.: US 9,460,691 B2
(45) Date of Patent: Oct. 4, 2016

(54) PIXEL, PIXEL DRIVING METHOD, AND DISPLAY DEVICE COMPRISING THE PIXEL

(71) Applicant: SAMSUNG DISPLAY CO., LTD., Yongin, Gyeonggi-Do (KR)

(72) Inventor: Su Weon Kim, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/588,097

(22) Filed: Dec. 31, 2014

(65) Prior Publication Data

US 2016/0012799 A1 Jan. 14, 2016

(30) Foreign Application Priority Data

Jul. 9, 2014 (KR) ..... 10-2014-0086107

(51) Int. Cl.
*G09G 3/32* (2016.01)
*G09G 5/18* (2006.01)

(52) U.S. Cl.
CPC ..... *G09G 5/18* (2013.01); *G09G 3/3208* (2013.01); *G09G 2300/0426* (2013.01)

(58) Field of Classification Search
CPC ..... G09G 2300/0426; G09G 3/3208; G09G 5/18; G09G 2320/0285; G09G 2320/0295; G09G 2320/045; G09G 3/3233; G09G 3/3258
USPC ..... 345/204, 205, 690, 76–83; 315/169.3
See application file for complete search history.

(56) References Cited

U.S. PATENT DOCUMENTS

2008/0036703 A1* 2/2008 Wang ..... G09G 3/006 345/76
2009/0140959 A1* 6/2009 Nam ..... G09G 3/3233 345/76
2012/0169704 A1* 7/2012 Chung ..... G09G 3/3233 345/212
2013/0088417 A1* 4/2013 Kim ..... G09G 3/3233 345/82
2014/0176525 A1* 6/2014 Woo ..... G09G 3/3233 345/212
2015/0029171 A1* 1/2015 Jo ..... G09G 3/3258 345/212

FOREIGN PATENT DOCUMENTS

KR 10-0844783 7/2008
KR 10-2009-0111082 10/2009
KR 10-2011-0035049 4/2011
KR 10-2011-0065172 6/2011
KR 10-2013-0066449 6/2013

* cited by examiner

*Primary Examiner* — Hong Zhou
(74) *Attorney, Agent, or Firm* — Lewis Roca Rothgerber Christie LLP

(57) ABSTRACT

An exemplary embodiment of the present invention provides a pixel including: a pixel including: a switching transistor configured to perform a switching operation according to a scan signal, the switching transistor including a first terminal that is coupled to a data line and a second transistor; a driving transistor configured to control a driving current according to a data signal that is transferred when the switching transistor is turned on, the driving transistor including a gate that is coupled to the second terminal of the switching transistor; a light-emitting element comprising a cathode and configured to emit light according to the driving current; and a contact transistor configured to perform a switching operation according to a sensing control line, the contact transistor including a first terminal coupled to the cathode electrode of the light-emitting element and a second terminal that is coupled to a sensing line to which a current of the driving transistor is applied.

13 Claims, 6 Drawing Sheets

PIXEL, PIXEL DRIVING METHOD, AND DISPLAY DEVICE COMPRISING THE PIXEL

CROSS-REFERENCE TO RELATED APPLICATION

This application claims priority to and the benefit of Korean Patent Application No. 10-2014-0086107 filed in the Korean Intellectual Property Office on Jul. 9, 2014, the entire contents of which are incorporated herein by reference.

BACKGROUND

1. Field

Embodiments of the present invention relate to a pixel, a pixel driving method, and a display device including the pixel.

2. Description of the Related Art

An organic light emitting display has a display area formed by arranging a plurality of pixels PX on a substrate in a matrix form, and performs display by connecting each pixel to a scan line and a data line and selectively applying a data signal to the pixel.

The organic light emitting display is a flat panel display that displays an image by using organic light emitting diodes (OLEDs) which generate light by re-combining electrons and holes, and has been in the spotlight because it has a quick response speed, low power consumption, and excellent emission efficiency, luminance, and viewing angle.

The pixels PX, which emit light in the organic light emitting display, include OLEDs, and the OLEDs generate light having a luminance (e.g., a predetermined luminance) in accordance with a data current supplied to the pixels.

Each of the pixels R, G, and B within the organic light emitting display panel is generally driven by a thin film transistor (TFT) circuit to emit light, and each pixel includes a plurality of transistors and capacitors to emit light.

An auxiliary electrode may be formed to improve a sheet resistance of a thin cathode electrode formed on an entire surface of an upper side of a light emitting layer. However, the position of the auxiliary electrode is limited to a non-emission region, and thus the sheet resistance is not sufficiently improved at a middle portion on a screen. Accordingly, a driving voltage needs to be increased to compensate for a voltage drop, which causes power consumption to be increased and lifespan to be shortened.

The above information disclosed in this Background section is only for an enhancement of understanding of the background of the present invention and therefore it may contain information that does not form the prior art that is already known in this country to a person of ordinary skill in the art.

SUMMARY

Embodiments of the present invention may reduce a sheet resistance of a cathode and lower a driving voltage by using a pixel sensing line, thereby accomplishing a driving stability.

However, the technical uses of the present invention are not limited to the above, and other non-mentioned objects will be clearly understood by a person of ordinary skill in the art by way of the following description.

An exemplary embodiment of the present invention provides a pixel including: a switching transistor configured to perform a switching operation according to a scan signal, the switching transistor including a first terminal that is coupled to a data line and a second terminal; a driving transistor configured to control a driving current according to a data signal that is transferred when the switching transistor is turned on, the driving transistor including a gate that is coupled to the second terminal of the switching transistor; a light-emitting element comprising a cathode and configured to emit light according to the driving current; and a contact transistor configured to perform a switching operation according to a sensing control line, the contact transistor including a first terminal coupled to the cathode electrode of the light-emitting element and a second terminal that is coupled to a sensing line to which a current of the driving transistor is applied.

The pixel may further include a sensing control transistor configured to perform a switching operation according to a sensing control signal, the sensing control transistor including a first terminal that is coupled to a second terminal of the driving transistor and a second terminal that is coupled to the sensing line.

The sensing control transistor may be an n-type transistor, and the contact transistor may be a p-type transistor.

A voltage and a current of the driving transistor may be applied to the sensing line.

Each of the scan signal, the sensing control signal, and a contact signal may include an enable pulse.

Another exemplary embodiment of the present invention provides a method of driving a pixel, the method including: turning on a sensing control transistor according to a sensing control signal; turning on a contact transistor according to a contact signal; and resetting a source of a driving transistor to a first power source voltage through the turned-on sensing control transistor and the turned-on contact transistor.

The method may further include: turning on a switching transistor according to a scan signal; and turning on the driving transistor by applying a data signal to a gate of the driving transistor through the turned-on switching transistor.

The method may further include: maintaining a turn-on state of the sensing control transistor according to the sensing control signal; turning off the contact transistor according to the contact signal; and sensing a voltage and a current of the driving transistor by the turned-on sensing control transistor.

Yet another exemplary embodiment of the present invention provides a display device including: a plurality of scan lines; a plurality of sensing control lines; a plurality of data lines; and a plurality of pixels each of which is coupled to a corresponding one of the scan lines, a corresponding one of the sensing control lines, and a corresponding one of the data, wherein each of the pixels includes: a switching transistor configured to perform a switching operation according to a scan signal, the switching transistor including a first terminal that is coupled to a data line and a second terminal; a driving transistor configured to control a driving current according to a data signal that is transferred when the switching transistor is turned on, the driving transistor including a gate that is coupled to the second terminal of the switching transistor; a light-emitting element comprising a cathode and configured to emit light according to the driving current; and a contact transistor configured to perform a switching operation according to a sensing control line, the contact transistor including a first terminal coupled to the cathode electrode of the light-emitting element and a second terminal that is coupled to a sensing line to which a current of the driving transistor is applied.

The display device may further include a sensing control transistor configured to perform a switching operation according to a sensing control signal, the sensing control transistor including a first terminal that is coupled to the second terminal of the driving transistor and a second terminal that is coupled to the sensing line.

The sensing control transistor may be an n-type transistor, and the contact transistor may be a p-type transistor.

A voltage and a current of the driving transistor may be applied to the sensing line.

Each of the scan signal, the sensing control signal, and a contact signal may include an enable pulse.

According to the exemplary embodiments of the present invention, the pixel, the pixel driving method, and a display device including the pixel may reduce a sheet resistance of a cathode electrode and lower a driving voltage by using a pixel sensing line.

DETAILED DESCRIPTION

Hereinafter, exemplary embodiments of the present invention will be described in detail with reference to the accompanying drawings. Herein, the same or similar components will be denoted by the same key numerals, and overlapping descriptions thereof may be omitted. The terms "module" and "unit" are used for describing components in the following description to make the specification easier to understand. Therefore, these terms do not have meanings or roles that distinguish components from each other by themselves. In describing exemplary embodiments of the present invention, when it is determined that a detailed description of well-known components or art associated with embodiments of the present invention may obscure the features of embodiments of the present invention, the detailed description of the components or art will be omitted. The accompanying drawings are provided only in order to allow exemplary embodiments disclosed herein to be easily understood and are not to be interpreted as limiting the present invention. It is to be understood that the present invention includes all modifications, equivalents, and substitutions without departing from the scope and spirit of the present invention.

Terms including ordinal numbers such as first, second, and the like, are used herein to describe various components, and should not be interpreted as limiting these components. The terms are only used to differentiate one component from other components.

It is to be understood that when one component is referred to as being "on," "connected to," "coupled to," or "attached to" another component, it may be on, connected, coupled, or attached directly to another component or be on, connected to, coupled to, or attached to another component with one or more other components interposed therebetween. It is to be understood that when one component is referred to as being "directly on," "directly connected to," "directly coupled to," or "directly attached to" another component, it may be on, connected to, coupled to, or attached to another component without any other component interposed therebetween.

Singular forms include plural forms unless the context clearly indicates otherwise.

Terms such as "comprises," "includes" or "have" when used herein specify the presence of stated features, numerals, steps, operations, components, parts, or a combination thereof, but do not preclude the presence or addition of one or more other features, numerals, steps, operations, components, parts, or a combination thereof.

Hereinafter, a display device according to an exemplary embodiment of the present invention will be described with reference to FIG. 1.

Figure 1:
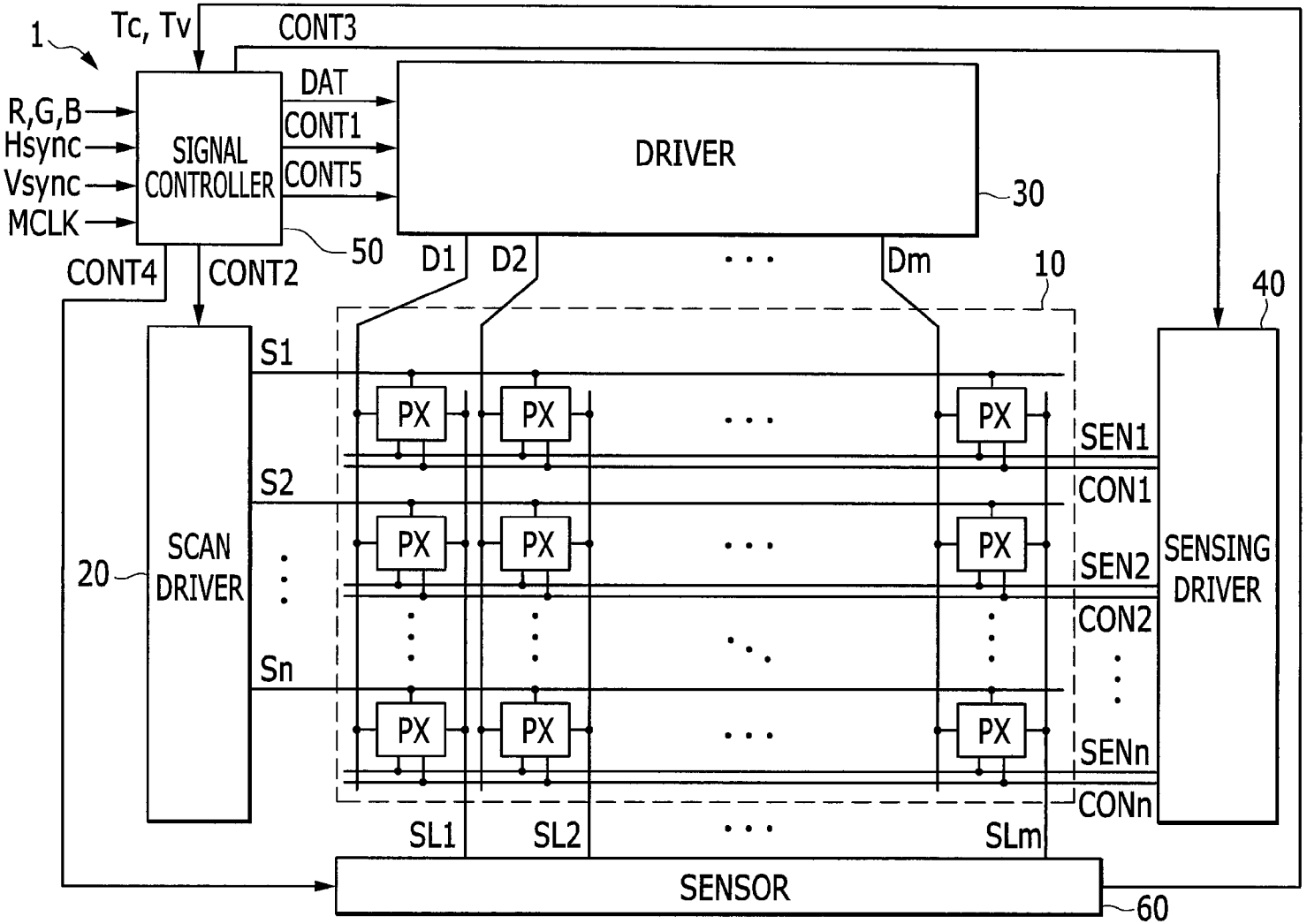
FIG. 1 shows a display device according to an exemplary embodiment of the present invention.

FIG. 1 shows a display device according to an exemplary embodiment of the present invention.

As shown in FIG. 1, the display device 1 includes a display unit 10, a scan driver 20, a data driver 30, a sensing driver 40, a signal controller 50, and sensor 60.

The display unit 10 includes a plurality of scan lines S1-Sn, a plurality of sensing control lines SEN1-SENn, a plurality of contact lines CON1-CONn, a plurality of data lines D1-Dm, a plurality of sensing lines SL1-SLm, and a plurality of pixels PX.

The scan lines S1-Sn, the sensing control lines SEN1-SENn, and the contact lines CON1-CONn are arranged along a vertical direction. Each of the scan line S1-Sn, the sensing control lines SEN1-SENn, and the contact lines CON1-CONn extends in a horizontal direction that is substantially perpendicular to the vertical direction.

The data lines D1-Dm and the sensing lines SL1-SLm are arranged along the horizontal direction. Each of the data line D1-Dm and the sensing lines SL1-SLm extends in the vertical direction.

Each of pixels PX is connected (e.g., coupled) to a corresponding line of the scan lines S1-Sn, a corresponding line of sensing control lines SEN1-SENn, a corresponding line of contact lines CON1-CONn, a corresponding line of data lines D1-Dm, and a corresponding line of sensing line SL1-SLm.

The scan driver 20 applies a plurality of scan signals S[1]-S[n] to the scan lines S1-Sn according to a scan control signal CONT2.

The data driver 30 generates a plurality of data signals (e.g., data voltages) in response to a data signal DAT that is inputted according to a data control signal CONT1 to supply them to the data lines D1-Dm. For example, the data driver 30 is synchronized with a time point at which a scan signal of an enable signal (gate on) voltage corresponding to each frame is supplied, to thereby supply them to the data lines D1-Dm. The data signals may be set to a test level (e.g., a predetermined level) to test a light emission level of each of the pixels PX.

Herein, the enable level (gate on) voltage indicates a level for turning on a switching transistor included in each of the pixels PX.

The data driver 30 generates a plurality of data signals (e.g., data voltages) in response to the data signal DAT generated according to a data control signal CONT5 to supply them to the data lines D1-Dm. For example, the data driver 30 is synchronized with a time point at which a scan signal of an enable signal (gate on) voltage corresponding to each frame is supplied, to thereby transfer a plurality of data signals for controlling the light emission level of each of the pixels PX through the data lines D1-Dm.

In the present exemplary embodiment, for each of an emission period and a sensing period, data control signals for controlling the data driver are divided into a data control signal CONT1 and a data control signal CONT5

However, in the exemplary embodiment, the emission period and sensing period are temporally separated from each other, and thus one data control signal may include different information according to each period. In this case, the data driver can be controlled by using one data control signal CONT1 or CONT5 instead of using the two data control signals CONT1 and CONT5.

The sensing driver 40 supplies a plurality of sensing control signals SEN[1]-SEN[n] to the sensing control lines SEN1-SENn according to a sensing control signal CONT4.

The sensor 60 senses a test driving current Tc flowing in the sensing lines SL1-SLm and transfer it to the signal controller 50. The sensor 60 can further sense a voltage (hereinafter, referred to as test voltage Tv) transferred through the sensing lines SL1-SLm to transfer it to the signal controller 50. For example, in a pixel structure of FIG. 2, a source of a driving transistor T1 is connected (or coupled) to the sensing line SLm through a transistor T3, and thus a source voltage of the driving transistor is transferred to the signal controller 50 along with the test driving current.

The signal controller 50 receives image signals R, G, and B that are inputted from the outside and an input control signal for controlling the display of the image signals R, G, and B. The image signals R, G, and B contain luminance information related to each of the pixels PX, and the luminance information includes data indicating a gray of a corresponding pixel among a number of grays (e.g., a predetermined number of grays), for example, 1024 ($=2^{10}$) 256 ($=2^{8}$) or 64 ($=2^{6}$) grays. The input control signal includes a vertical synchronization signal Vsync, a horizontal synchronizing signal Hsync, and a main clock MCLK.

The signal controller 50 measures a time period in which the source voltage of the driving transistor increases by using the source voltage of the driving transistor and the test driving current, to sense a transistor characteristic and to generate the data signal DAT that is compensated according to the transistor characteristic.

Specifically, the signal controller 50 senses the transistor characteristic by using a threshold voltage of the driving transistor and an I-V curve of an organic light emitting element (OLED) and to generate the data signal DAT that is compensated according to the transistor characteristic. As a result, the signal controller 50 generates the data control signal CONT1, the scan control signal CONT2, a sensing driving control signal CONT3, the sensing control signal CONT4, the data control signal CONT5, and the data signal DAT.

The signal controller 50 transfers the scan control signal CONT2 to the scan driver 20, and the data control signal CONT1, the data control signal CONT5, and the data signal DAT to the data driver 30. The signal controller 50 transfers the sensing driving control signal CONT3 to the sensing driver 40, and the sensing control signal CONT4 to the sensor 60.

Each of the pixels PX is synchronized with a scan signal that is supplied through a scan line to receive the data signal DAT or a compensated image data signal

DAT.

The data signal inputted into a pixel PX is written to the pixel PX according to a corresponding data signal DAT. The data signal DAT is written to the pixel PX, and a test driving current according to the written data signal DAT is supplied to the organic light emitting diode serving as the light emitting element included in the pixel PX according to a corresponding light emitting signal.

Figure 2:
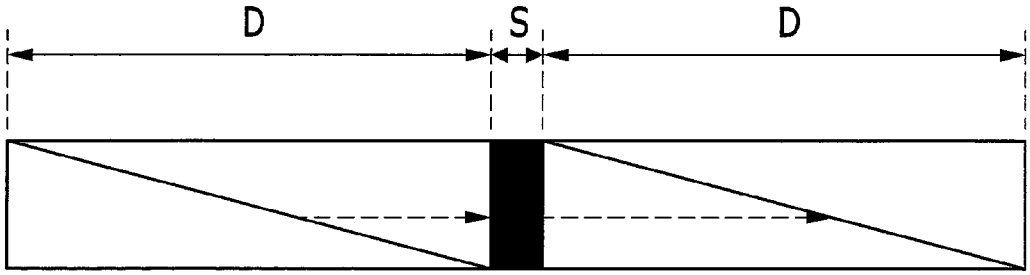
FIG. 2 is a timing diagram illustrating a unit driving period of a display device according to an exemplary embodiment of the present invention.

FIG. 2 is a timing diagram illustrating a unit driving period of a display device according to an exemplary embodiment of the present invention.

The unit driving period shown in FIG. 2 is a period corresponding to one frame.

In FIG. 2, it is illustrated that an emission period D follows a sensing period S in one frame. However, the sensing period S may be positioned before the start of the emission period D.

In the organic light emitting diode, differences are generated in characteristics such as a mobility and a threshold voltage Vth of the driving transistor in each pixel due to process variation and the like. These characteristic differences cause the amount of current required for driving the organic light emitting diode to become different, thereby generating luminance deviation between pixels. As a method for solving the problem caused by the luminance deviation between pixels, an external compensation method for measuring and compensating the current of the driving transistor is suggested.

Specifically, in order to perform external compensation, a source voltage of a driving transistor included in a pixel to be sensed is reset to be a reference voltage before the emission period D, and a transistor characteristic is measured by turning on the driving transistor and measuring a time for which the source voltage is increased to correct driving data according to the transistor characteristic. In the present exemplary embodiment, the compensation indicates generating a data signal DAT according to the characteristic of the driving transistor.

Figure 3:
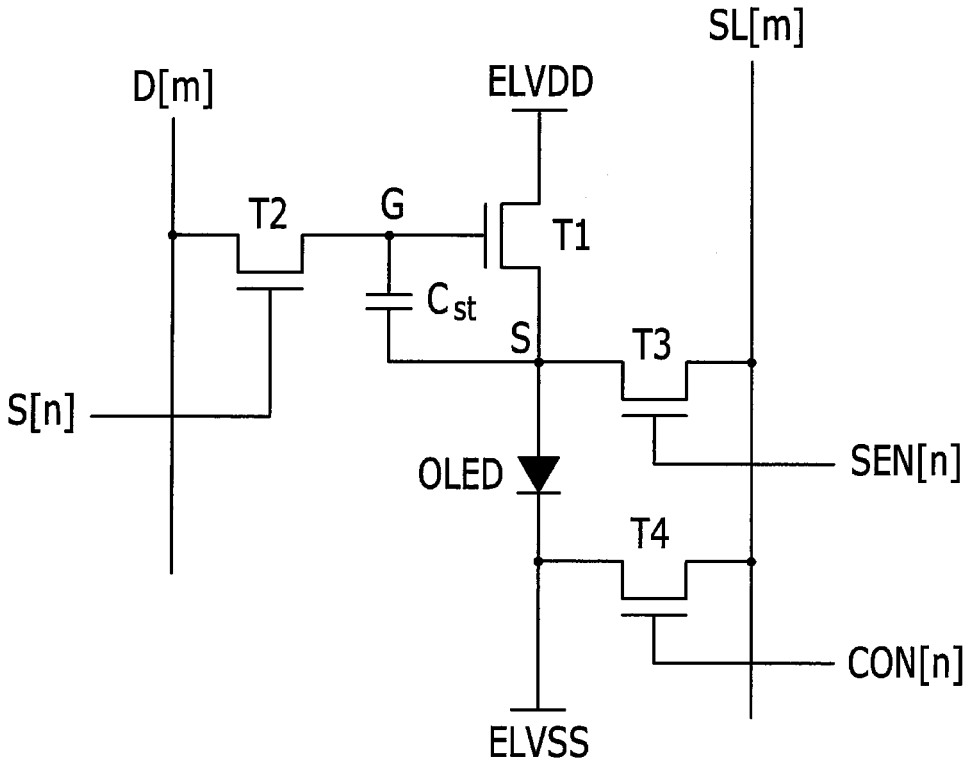
FIG. 3 illustrates a pixel according to an exemplary embodiment of the present invention.

FIG. 3 illustrates a pixel according to an exemplary embodiment of the present invention.

Hereinafter, a pixel PX according to an exemplary embodiment of the present invention will be described with reference to FIG. 3.

In FIG. 3, it is illustrated that a pixel PX is connected to a $n^{th}$ scan line Sn, a $n^{th}$ sensing control line SENn, a $n^{th}$ contact line CONn, a $m^{th}$ data line Dm, and a $m^{th}$ sensing line SLm.

As shown in FIG. 3, the pixel PX includes a driving transistor T1, a switching transistor T2, a sensing control transistor T3, a contact transistor T4, a storage capacitor Cst, and an organic light emitting diode OLED.

A power source voltage ELVDD and a power source voltage ELVSS are set as a level for supplying a driving voltage that is used for the operation of the pixel PX. For example, the power source voltage ELVDD is set as a voltage that is higher than the power source voltage ELVSS such that a difference between the two voltages ELVDD and ELVSS is equal to or larger than a level (e.g., a predetermined level) that is used for the operation of the pixel PX.

The switching transistor T2 includes a first terminal that is connected to a data line Dm, a second terminal that is connected to a node G, and a gate that is connected to a scan line Sn.

The sensing control transistor T3 includes a first terminal that is connected to a node S, a second terminal that is connected to a sensing line SLm, and a gate that is connected to a sensing control line SENn.

The contact transistor T4 includes a first terminal that is connected to the sensing line SLm, a second terminal that is connected to a cathode of the organic light emitting diode, and a gate that is connected to a contact line CONn.

During an emission period E in which a problem is generated due to a voltage drop (IR DROP), an image quality such as a screen spot can be improved and a driving voltage can be lowered by connecting the cathode of the organic light emitting diode OLED to the sensing line SLm through the contact transistor T4, to thereby accomplish a driving stability. The driving transistor T1 includes a first terminal that is connected to the power source voltage ELVDD, a second terminal that is connected to the node S, and a gate that is connected to the node G.

The storage capacitor Cst is connected between the node G and the node S.

An anode of the organic light emitting diode OLED is connected to the node S, and a cathode thereof is connected to the second terminal of the contact transistor T4.

Figure 4:
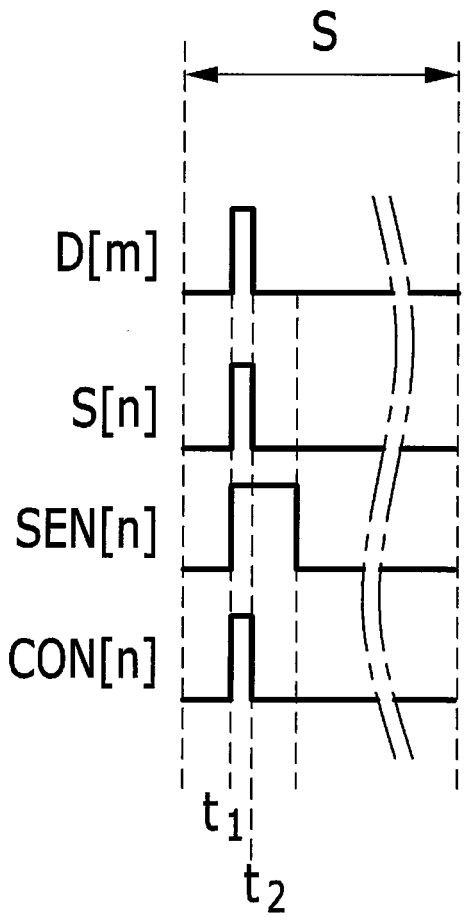
FIG. 4 is a timing diagram illustrating a unit driving period of a display device according to an exemplary embodiment of the present invention.

FIG. 4 is a timing diagram illustrating a unit driving period of a display device according to an exemplary embodiment of the present invention.

In FIG. 4, signals of a sensing period S of one frame 1F are illustrated.

Specifically, FIG. 4 illustrates a data signal D[m], scan signal S[n], sensing control signal SEN[n] and contact signal CON[n] among a plurality of data signals, a plurality of scan signals, a plurality of sensing control signals, and a plurality of contact signals, respectively.

Each of the data signals, the scan signals, the sensing control signals, and the contact signals includes an enable pulse, and the enable pulses of the data signals, the scan signals, the sensing control signals, and the contact signals are sequentially generated. In the present exemplary embodiment, the driving transistor T1, the switching transistor T2, the sensing control transistor T3, and the contact transistor T4 are transistors of n channel type, and thus an enable level is a high level. However, the present exemplary embodiment is not limited thereto. That is, the enable level may be varied according to the channel type of the driving transistor T1, the switching transistor T2, the sensing control transistor T3, and the contact transistor T4.

By referring to FIG. 4, at a time point t1, each of the sensing control transistor T3, the contact transistor T4, and the switching transistor T2 are respectively turned on by the enables pulses of the sensing control signal SEN[n], the contact signal CON[n] and the scan signal S[n].

First, once the sensing control transistor T3 and the contact transistor T4 are turned on, a path is formed between the node S and the power source voltage ELVSS by the sensing control transistor T3 and the contact transistor T4 that are turned on. A source of the driving transistor T1 is reset to the power source voltage ELVSS by the formed path.

When the switching transistor T2 is turned on, the storage capacitor Cst is charged by the data signal D[m]. Further, when the switching transistor T2 is turned on, the driving transistor T1 is turned on by the enable pulse of the data signal D[m].

Next, at a time point t2, the contact transistor T4 and the switching transistor T2 are respectively turned off by the disable pulses of the contact signal CON[n] and the scan signal S[n]. The turn-on state of the sensing control transistor T3 is maintained by the enable pulse of the sensing control signal SEN[n].

A path is formed between the power source voltage ELVDD and the sensing line SLm through the driving transistor T1 and the sensing control transistor T3, and the test driving current Tc of the driving transistor T1 and the test voltage Tv of the driving transistor are applied to the sensing line SLm. At the time point t1, the test driving current Tc is determined according to a threshold voltage of the driving transistor T1 and the data signal D[m] written to the gate of the driving transistor T1.

In the present exemplary embodiment, the organic light emitting diode OLED emits no light during the sensing period S. Specifically, during the sensing period S, a current flows in the driving transistor T1 of a sensing target pixel PX. However, since a path is generated between the power source voltage ELVDD and the sensing line SLm through the sensing control transistor T3, no current flows in the organic light emitting diode OLED. A data signal having a disable pulse (e.g., 0V) is applied to other pixels than the sensing target pixel, and thus the driving transistor T1 is turned off. As a result, no current flows in the organic light emitting diode OLED.

Figure 5:
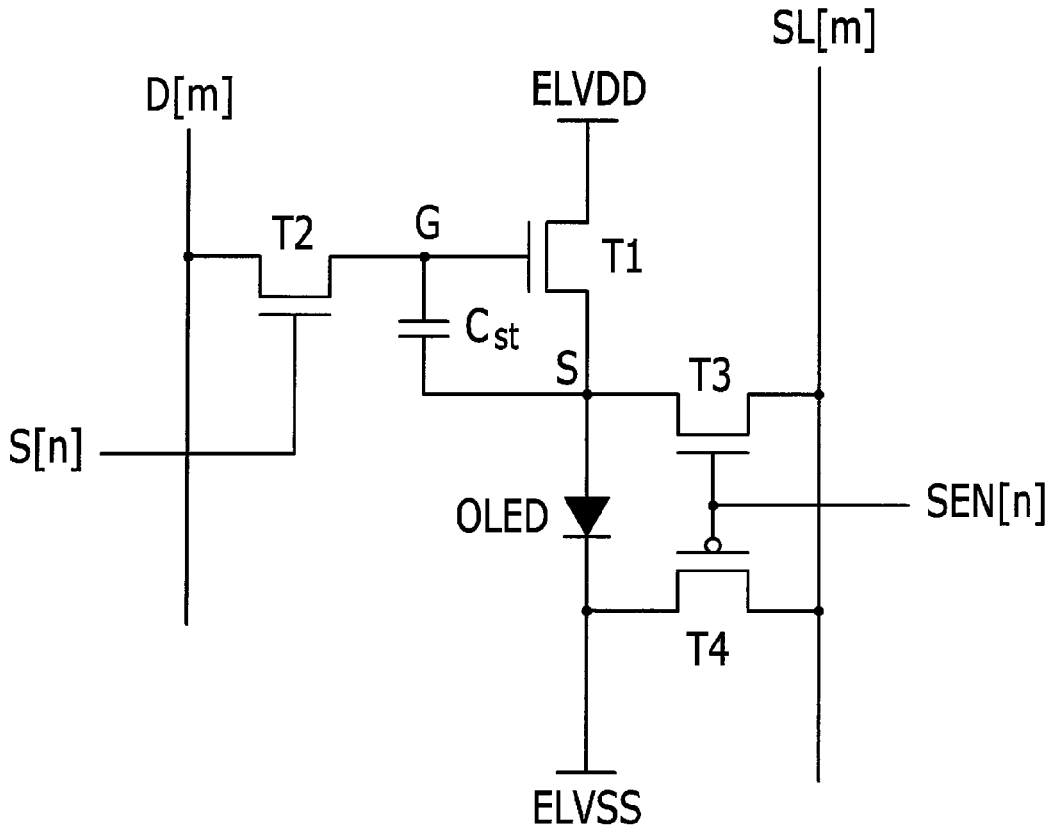
FIG. 5 illustrates a pixel according to an exemplary embodiment of the present invention.

FIG. 5 illustrates a pixel according to an exemplary embodiment of the present invention.

An exemplary embodiment of FIG. 5 is different from the exemplary embodiment of FIG. 3 with regards to the contact transistor T4 and the contact line CONn. The same reference numerals designate the same elements in the previous exemplary embodiment, and a detailed description thereof will be omitted hereinafter.

According to the exemplary embodiment of FIG. 5, a pixel PX includes a driving transistor T1, a switching transistor T2, a sensing control transistor T3, a contact transistor T4, a storage capacitor Cst, and an organic light emitting diode OLED.

The contact transistor T4 includes a first terminal that is connected to the power source voltage ELVSS, a second terminal that is connected to the sensing line SLm, and a gate that is connected to the sensing control lines SENn.

Both of the gates of the sensing control transistor T3 and the contact transistor T4 are connected to the sensing control lines SENn.

The sensing control transistor T3 is an n-type transistor, and the contact transistor T4 is a p-type transistor. Accordingly, enable levels of the sensing control transistor T3 and the contact transistor T4 are different from each other.

In FIG. 5, it is illustrated that the sensing control transistor T3 and the contact transistor T4 are respectively the n-type transistor and the p-type transistor. However, the present invention is not limited thereto. Various types of transistors may be employed as the sensing control transistor T3 and the contact transistor T4.

Figure 6:
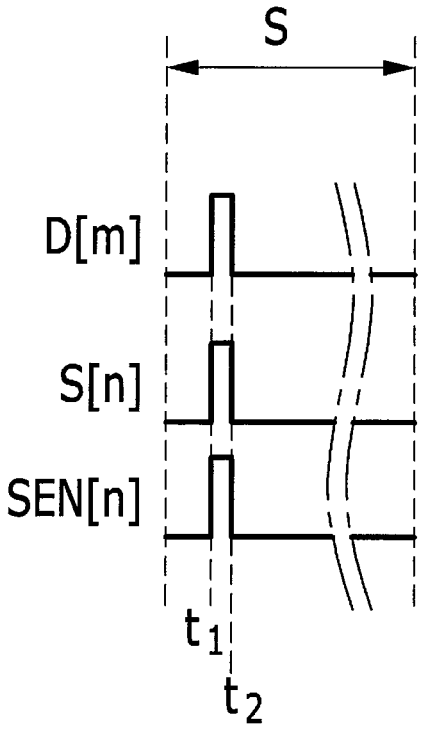
FIG. 6 is a timing diagram illustrating a unit driving period of a display device according to an exemplary embodiment of the present invention.

FIG. 6 is a timing diagram illustrating a unit driving period of a display device according to an exemplary embodiment of the present invention.

At the time point t1, the sensing control transistor T3 and the switching transistor T2 are respectively turned on by the enable pulses of the sensing control signal SEN[n] and the scan signal S[n].

The contact transistor T4 is turned off by the disable pulse of the sensing control signal SEN[n].

When the switching transistor T2 is turned on, the storage capacitor Cst is charged by the data signal D[m]. In addition, the driving transistor T1 is turned on by the enable pulse of the data signal D[m].

When the sensing control transistor T3 is turned on but the contact transistor T4 is turned off, a path is formed between the power source voltage ELVDD and the sensing line SLm through the driving transistor T1 and the sensing control transistor T3. The test driving current Tc of the driving transistor T1 and the test voltage Tv of the driving transistor is applied to the sensing line SLm.

While embodiments of the present invention have been described in connection with what is presently considered to be practical exemplary embodiments, it is to be understood that the present invention is not limited to the disclosed embodiments, but, on the contrary, is intended to cover various modifications and equivalent arrangements which are included within the spirit and scope of the present invention as defined by the appended claims and their equivalents. Therefore, the above detailed description is not to be interpreted as being restrictive, but is to be considered as being illustrative. The scope of the present invention is to be determined by reasonable interpretation of the claims, and all alterations and equivalences of the present invention which fall within the scope of the present invention.

DESCRIPTION OF SYMBOLS

1: display device
10: display unit
20: scan driver
30: data driver
40: sensing driver
50: signal controller
60: sensor

What is claimed is:

1. A pixel comprising:

a switching transistor configured to perform a switching operation according to a scan signal, the switching transistor comprising a first terminal that is coupled to a data line and a second terminal;

a driving transistor configured to control a driving current according to a data signal that is transferred when the switching transistor is turned on, the driving transistor comprising a first terminal and a gate that is coupled to the second terminal of the switching transistor;

a light-emitting element comprising an anode and a cathode and configured to emit light according to the driving current, the anode of the light-emitting element being coupled to the first terminal of the driving transistor; and a contact transistor configured to perform a switching operation according to a sensing control line, the contact transistor comprising a first terminal coupled to the cathode of the light-emitting element and a second terminal that is coupled to a sensing line to which a current of the driving transistor is applied.

2. The pixel of claim 1, further comprising a sensing control transistor configured to perform a switching operation according to a sensing control signal, the sensing control transistor comprising a first terminal that is coupled to a second terminal of the driving transistor and a second terminal that is coupled to the sensing line.

3. The pixel of claim 2, wherein the sensing control transistor is an n-type transistor, and the contact transistor is a p-type transistor.

4. The pixel of claim 3, wherein a voltage and a current of the driving transistor are applied to the sensing line.

5. The pixel of claim 4, wherein each of the scan signal, the sensing control signal, and a contact signal comprises an enable pulse.

6. A method of driving a pixel, the method comprising:

turning on a sensing control transistor according to a sensing control signal, the sensing control transistor comprising a first electrode coupled to an anode of a light-emitting element;

turning on a contact transistor according to a contact signal, the contact transistor comprising a first electrode coupled to a cathode of the light-emitting element; and resetting a source of a driving transistor to a first power source voltage through the turned-on sensing control transistor and the turned-on contact transistor.

7. The method of claim 6, further comprising:

turning on a switching transistor according to a scan signal; and turning on the driving transistor by applying a data signal to a gate of the driving transistor through the turned-on switching transistor.

8. The method of claim 7, further comprising:

maintaining a turn-on state of the sensing control transistor according to the sensing control signal;

turning off the contact transistor according to the contact signal; and sensing a voltage and a current of the driving transistor by the turned-on sensing control transistor.

9. A display device comprising:

a plurality of scan lines;

a plurality of sensing control lines;

a plurality of data lines; and a plurality of pixels each of which is coupled to a corresponding one of the scan lines, a corresponding one of the sensing control lines, and a corresponding one of the data, wherein each of the pixels comprises:

a switching transistor configured to perform a switching operation according to a scan signal, the switching transistor comprising a first terminal that is coupled to a data line and a second terminal;

a driving transistor configured to control a driving current according to a data signal that is transferred when the switching transistor is turned on, the driving transistor comprising a first electrode and a gate that is coupled to the second terminal of the switching transistor;

a light-emitting element comprising an anode and a cathode and configured to emit light according to the driving current, the anode of the light-emitting element being coupled to the first terminal of the driving transistor; and a contact transistor configured to perform a switching operation according to a sensing control line, the contact transistor comprising a first terminal coupled to the cathode of the light-emitting element and a second terminal that is coupled to a sensing line to which a current of the driving transistor is applied.

10. The display device of claim 9, further comprising a sensing control transistor configured to perform a switching operation according to a sensing control signal, the sensing control transistor comprising a first terminal that is coupled to the second terminal of the driving transistor and a second terminal that is coupled to the sensing line.

11. The display device of claim 10, wherein the sensing control transistor is an n-type transistor, and the contact transistor is a p-type transistor.

12. The display device of claim 11, wherein a voltage and a current of the driving transistor are applied to the sensing line.

13. The display device of claim 12, wherein each of the scan signal, the sensing control signal, and a contact signal comprises an enable pulse.

* * * * *